US005518114A

United States Patent [19]

Kohring et al.

[11] Patent Number: 5,518,114

[45] Date of Patent: May 21, 1996

[54] CARTRIDGE DISPENSER

[75] Inventors: Douglas R. Kohring, Chelmsford, Mass.; Daniel B. Lazarchik, Richmond, United Kingdom

[73] Assignee: The Gillette Company, Boston, Mass.

[21] Appl. No.: 282,528

[22] Filed: Jul. 28, 1994

[51] Int. Cl.[6] ..... B65D 83/10

[52] U.S. Cl. ..... 206/352; 206/354; 30/40

[58] Field of Search ..... 206/352, 354, 206/355, 356, 560, 564; 80/32, 40, 40.2, 50

[56] References Cited

U.S. PATENT DOCUMENTS

| | | | |
|---|---|---|---|
| D. 224,997 | 10/1972 | Petrillo | D9/187 |
| D. 226,553 | 3/1973 | Glaberson | D9/189 |
| D. 233,417 | 10/1974 | Pomfret | D9/189 |
| D. 231,198 | 4/1974 | Casselli | D9/189 |
| D. 240,507 | 7/1976 | Hood | D9/189 |
| D. 247,349 | 2/1978 | Carr | D9/186 |
| D. 256,996 | 9/1980 | Kiraly | D9/189 |
| D. 256,997 | 9/1980 | Motta | D9/189 |
| D. 256,998 | 9/1980 | Motta | D9/189 |
| D. 306,216 | 2/1990 | Gray | D28/45 |
| D. 312,568 | 12/1990 | Gray | D9/342 |
| D. 316,962 | 5/1991 | Gray | D9/342 |
| 3,388,831 | 6/1968 | Hansom | 221/220 |
| 3,609,862 | 10/1971 | Berger | 30/90 |
| 3,771,223 | 11/1973 | Dawidowicz et al. | 30/40 |
| 3,797,657 | 3/1974 | Petrillo | 206/356 |
| 3,833,146 | 9/1974 | Braginetz | 206/356 X |
| 3,835,532 | 9/1974 | Petrillo | 30/40 |
| 3,854,201 | 12/1974 | Dawidowicz et al. | 30/40 |
| 3,880,284 | 3/1975 | Pomfret | 206/354 |
| 4,030,598 | 6/1977 | Pentney | 206/356 |
| 4,173,285 | 11/1979 | Kiraly et al. | 206/356 |
| 4,742,909 | 5/1988 | Apprille et al. | 206/356 |
| 5,113,586 | 5/1992 | Lazarchik et al. | 30/90 |

*Primary Examiner*—Jimmy G. Foster
*Assistant Examiner*—Tara Laster
*Attorney, Agent, or Firm*—Owen J. Meegan; Aubrey C. Brine; Donal B. Tobin

[57] ABSTRACT

A one piece receptacle for retaining and dispensing a plurality of razor blade cartridges has a plurality of cavities formed therein. Each of the cavities has structural elements disposed within the cavity for retaining a blade cartridge therein in spaced relation with the wall structure forming the respective cavity.

14 Claims, 5 Drawing Sheets

CARTRIDGE DISPENSER

BACKGROUND OF THE INVENTION

The present invention relates to wet shaving implements employing disposable cartridges which are removably connected to a razor handle, and more particularly to a receptacle for retaining the cartridges in side by side relation and oriented to be connected to a razor handle and dispensed for use in the shaving process.

In U.S. Pat. No. 4,742,909, issued to Apprille, Jr. et al. and assigned to the assignee of the present invention, there is disclosed a shaving cartridge retaining casing and storage tray of the type which is the subject of the present invention. The device comprises a tray having a plurality of individual casings which are adapted to retain a single safety razor cartridge unit which is detachably engageable with a safety razor handle. The structure in each casing retains the head unit of the cartridge against accidental removal in such a manner that the blade is protected against damage while held within the casing. Each of the cartridges when engaged with the handle is withdrawable from the casing by a rocking motion of the handle and the casings are slidable from the tray with the respective cartridge contained within the casing. Thus, a design of this type comprises a tray with separate casings one for each of the cartridges to be retained within the tray.

While the structure disclosed above has proved successful the manufacture of a separate casing for each of the razor blade cartridges, in addition to the tray for holding the casings requires a number of processing steps, as well as the employment of separate materials for the casings and the tray, adding to the expense of the razor blade cartridge dispenser.

It is therefore an object of the present invention to provide a one piece receptacle for retaining and dispensing the razor blade cartridges which retains the features of providing access to the cartridges for attachment to a razor handle while retaining the cartridges against accidental removal and protecting the blade contained in each cartridge.

A further object of the invention is to provide a one piece receptacle for retaining and dispensing a plurality of razor blade cartridges which is simple to manufacture and provides a saving in material and manufacturing cost over those of the prior art.

Another object of the invention is to provide a one piece receptacle for retaining and dispensing a plurality of razor blade cartridges which is easily adaptable to assembly into a razor holding device or other razor handling article.

SUMMARY OF THE INVENTION

The above objects and other objectives which will become apparent as the description proceeds are accomplished by providing a one piece receptacle for retaining and dispensing a plurality of razor blade cartridges which is open at the top and formed of a pair of opposed end walls a pair of opposed side walls and a bottom wall. Means interconnecting, and extending between, the opposed side walls is provided for dividing the receptacle into a plurality of individual cartridge cavities and a further means is disposed in each of the cavities for retaining a razor blade cartridge therein in spaced relation with each of the opposed side walls and the dividing means. The means for dividing the receptacle into a plurality of individual cartridge cavities comprises a plurality of separator walls which are disposed substantially parallel to each of the end walls and spaced one from the other, and from the end walls.

The means for retaining a razor blade cartridge in spaced relation in each of the cavities may comprise a pair of flanges each having one edge connected to one of the opposed side walls and one free edge extending inwardly, each of the flanges being spaced from an adjacent separator wall or end wall to form a respective razor retaining means. A detent is generally disposed adjacent the upper edge of each flange and extends outwardly from the surface thereof to retain a razor blade cartridge between the detent and the bottom wall of the receptacle.

The one piece receptacle may further have a pair of spacer elements disposed in each of the cavities one attached to each of the opposed side walls for retaining the razor blade cartridge therebetween and in spaced relation with the side walls.

The receptacle also may include means disposed on the end walls and the dividing means for guiding a razor blade cartridge into the razor blade cartridge retaining means.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
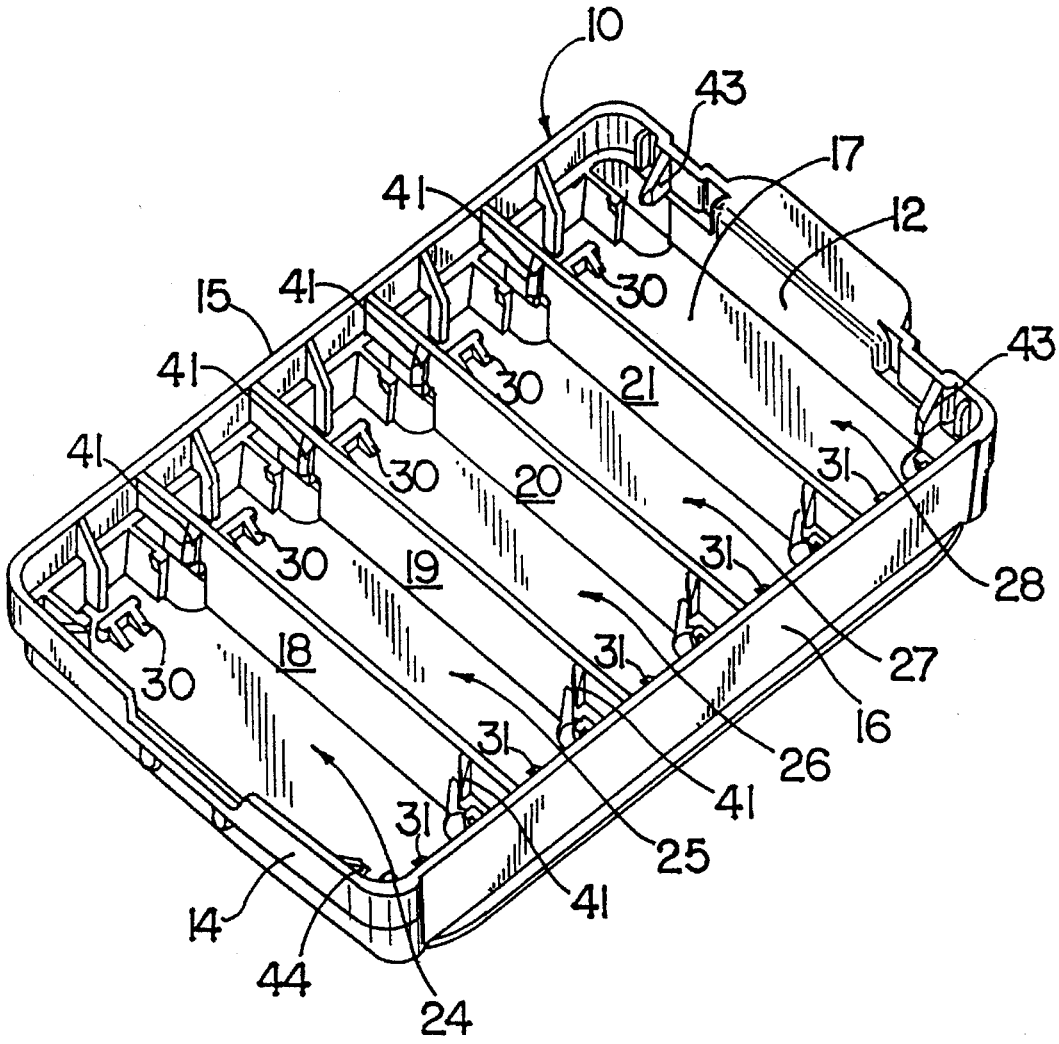
FIG. 1 is a front top perspective view showing a one piece receptacle for retaining and dispensing razor blade cartridges, which receptacle has been constructed in accordance with the teachings of the present invention.

Referring now to the drawing and in particular to FIGS. 1 through 5 there is shown a one piece receptacle 10 for retaining and dispensing a plurality of razor blade cartridges. The receptacle 10 comprises a pair of opposed end walls 12 and 14, a pair of opposed side walls 15 and 16, and a bottom wall 17. Dividing means in the form of a plurality of separating walls 18, 19, 20 and 21 extend between the opposed side walls 15 and 16 and together with the end walls 12 and 14 form a plurality of cavities 24, 25, 26, 27 and 28 each of which are adapted to retain a razor blade cartridge for attachment to a razor handle by the user.

Figure 2:
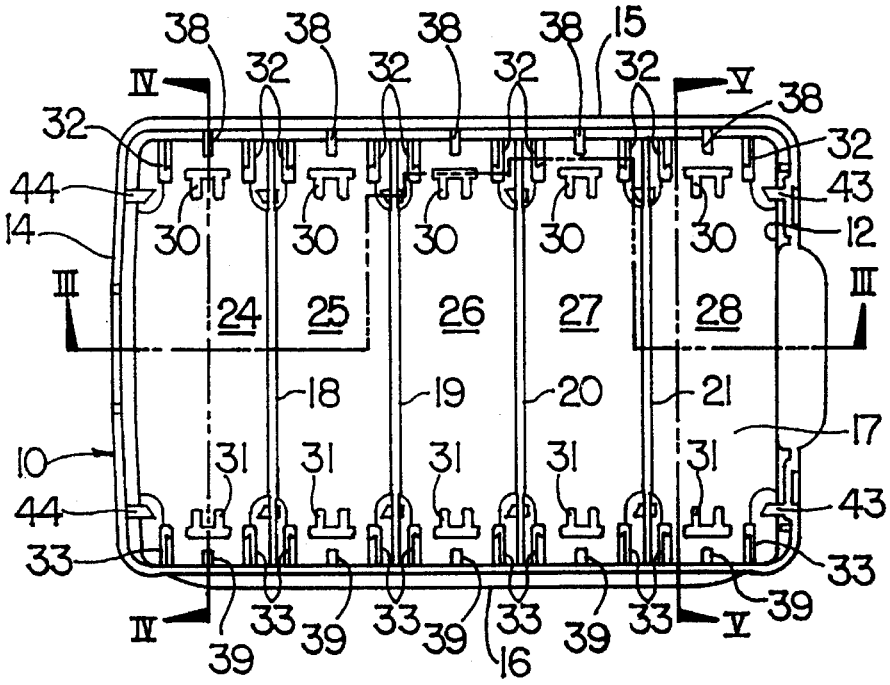
FIG. 2 is a top plan view showing details of the structure of FIG. 1.
Figure 3:
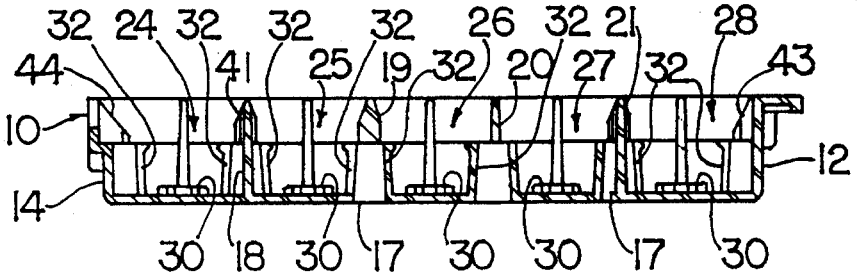
FIG. 3 is an elevational sectional view taken along the line III—III of FIG. 2 showing further details of the structure of FIGS. 1 and 2.
Figure 4:
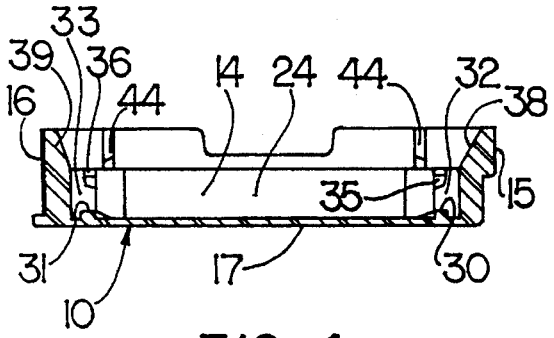
FIG. 4 is an elevational sectional view of the structure of FIGS. 1 through 3 taken along the line IV—IV of FIG. 2.
Figure 5:
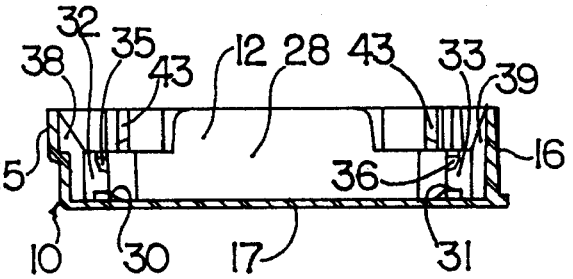
FIG. 5 is an elevational sectional view of the structure of FIGS. 1 through 4 taken along the line V—V of FIG. 2.
Figure 6:
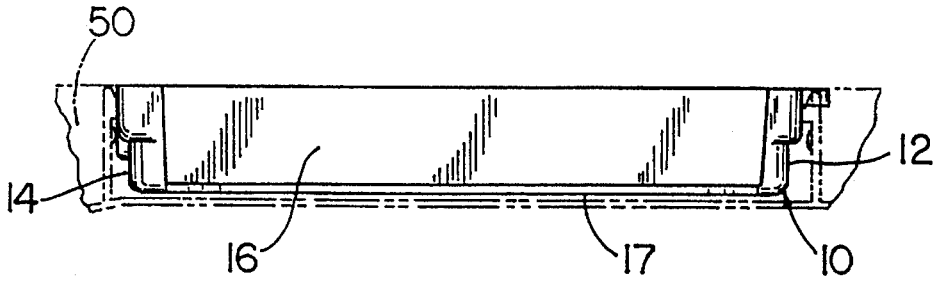
FIG. 6 is a left side elevational view of the structure of FIGS. 1 through 5, showing it retained in a razor support structure.
Figure 7:
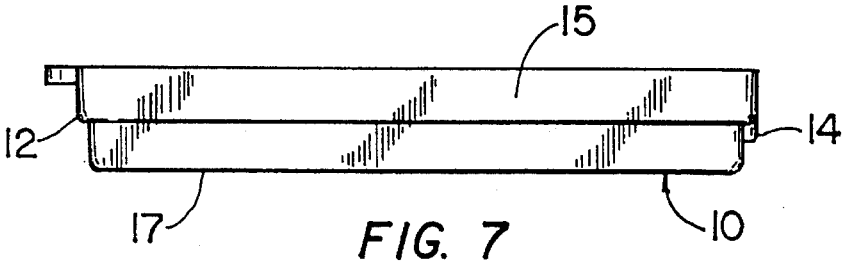
FIG. 7 is a right side elevational view showing details of that portion of the structure of FIGS. 1 through 6.
Figure 9:
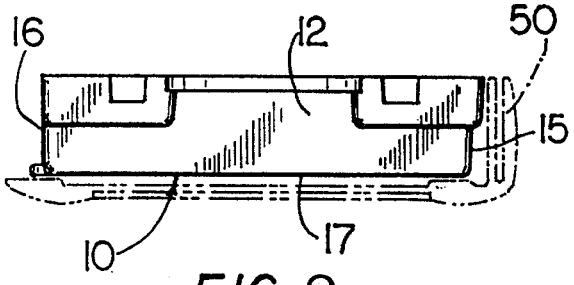
FIG. 9 is a rear elevational view of the structure of FIGS. 1 through 8 showing the receptacle engaged in a razor support structure.
Figure 8:
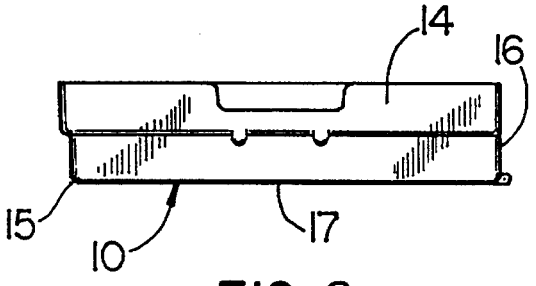
FIG. 8 is a front elevational view showing details of the structure of FIGS. 1 through 7.

As best shown in FIG. 2 and sectional FIGS. 3, 4, and 5 each of the cavities 24, 25, 26, 27 and 28 is provided with means for retaining a single razor blade cartridge within the respective cavity, the cartridge being supported in spaced relation with the end walls 12, 14, the side walls 15, 16 the bottom wall 17 and the separator walls 18, 19, 20 and 21. The retaining means is substantially symmetrical within each of the cavities 24, 25, 26, 27 and 28 and comprises a pair of upwardly projecting support members 30 and 31 formed on the bottom wall 17 in each of the respective cavities which are also effective to center a cartridge within its cavity.

Each of the cavities 24, 25, 26, 27 and 28 is further provided with a pair of flanges 32, each having an edge connected to the side wall 15 and bottom wall 17 and extending inwardly into a respective cavity and a pair of flanges 33 connected to the side wall 16 and extending in an opposite direction into the respective cavity. As best shown in FIGS. 4 and 5 each of the flanges 32 and 33 has an edge connected to the bottom wall 17 as well as either the side wall 15 or 16 and has a detent 35 or 36 disposed adjacent the upper edge and extending outwardly from a surface of the flange 32 or 33 respectively. Between each of the flanges 32 or the flanges 33 a spacer element 38 or 39 is formed on the side wall 15 or 16 respectively and extends inwardly into the cavity 24, 25, 26, 27 or 28 as is shown in FIGS. 4 and 5.

It will be noted that each of the spacer elements 38 and 39 has an upper edge which slants downwardly and inwardly into a respective cavity for the purpose of guiding a razor blade cartridge into the retaining position. Each of the cavities 24, 25, 26, 27 and 28 is further provided with means for guiding a razor blade cartridge into a respective retaining means in the form of guide members 41 disposed adjacent the upper edge of each of the separator walls 18, 19, 20 or 21 and guide members 43 formed adjacent the upper surface of end wall 12, and guide members 44 disposed adjacent the upper edge, and on the inner surface of, end wall 14.

Figure 10:
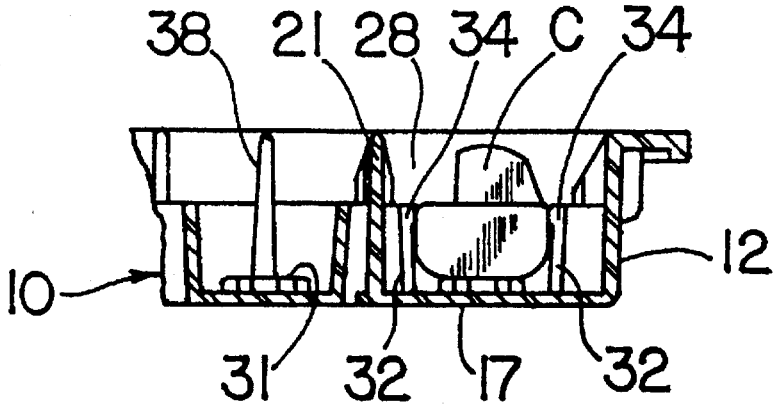
FIG. 10 is a fragmentary left side sectional view showing a razor blade cartridge retained in the receptacle of FIGS. 1 through 9.
Figure 11:
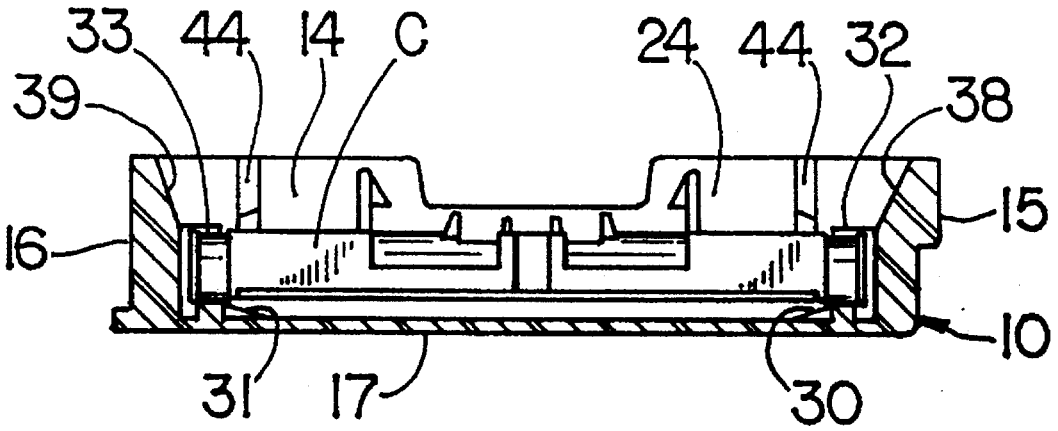
FIG. 11 is a cross-sectional elevational view showing a blade cartridge held in any of the cavities of the receptacle of FIGS. 1 through 10.
Figure 12:
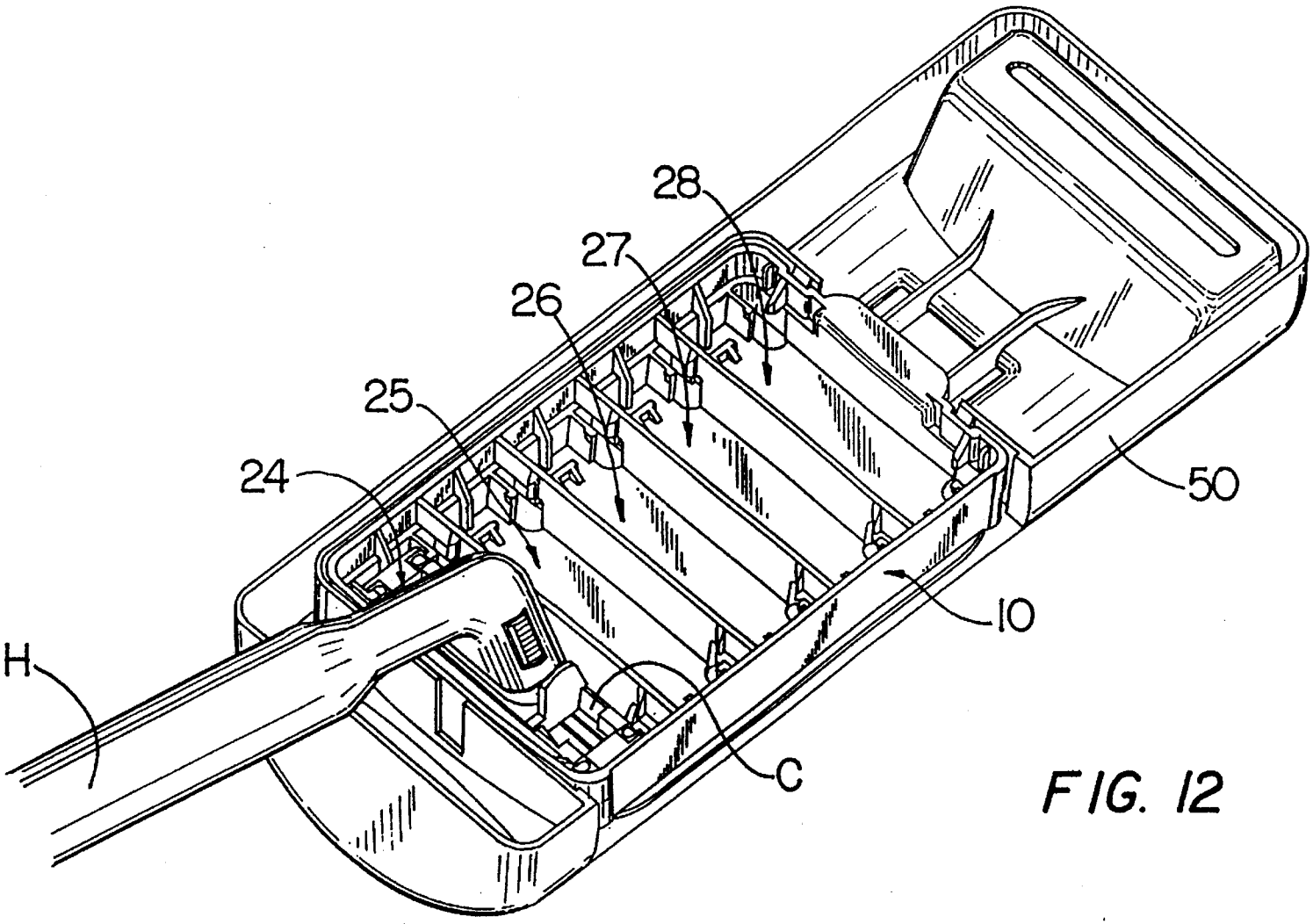
FIG. 12 is a front top perspective view similar to FIG. 1 showing the receptacle of FIGS. 1 through 11 mounted on a razor support structure with a razor handle engaged in a razor blade cartridge, prior to removal of the cartridge from the receptacle.

Referring now to FIGS. 6 through 12 and particularly to FIGS. 10 and 11, a razor blade cartridge C is shown as it is typically retained in a cavity 24, 25, 26, 27, or in the figures of the present drawing in cavity 28 in FIG. 10 or cavity 24 in FIG. 11. In each instance, the razor blade cartridge C is not retained by the receptacle walls but rather within a cartridge retaining means formed by the flanges 32 and 33 having detents 34 and 35 for contacting the cartridge, supported against sidewise movement by the spacer elements 38 and 39 and supported above the bottom walls 17 by the support members 30 and 31. Thus, it is evident that the means for retaining the razor blade cartridge C within a respective cavity 24, 25, 26, 27 and 28 is independent of the walls of the receptacle 10 allowing the receptacle to be manufactured of a material providing a rigidity suitable for mounting into a razor handle support as shown in FIG. 12, while maintaining the flexibility necessary to retain and dispense a razor blade cartridge C.

As shown in FIG. 12, the one piece receptacle 10 may be retained on the underside of a razor handle support member 50 as is commonly practiced, the razor handle itself being retained on the opposite side of the support member by any means (not shown) well known in the art. In FIG. 12, each of the cartridges C have been removed from the respective cavities 25, 26, 27 and 28 the remaining cartridge being held in the retaining means of the cavity 24 and the receptacle 10 being fixed in a recessed portion of the support member 50. The end wall 14 is slightly bowed outwardly in the present configuration such that it is a force fit within the cavity provided in the support member 50.

In removing the cartridge C from the receptacle 10 the razor handle H, as shown in FIG. 12, is attached to the razor blade cartridge C, generally by forcing the cartridge receiving end of the handle onto the cartridge with slight pressure, and the handle is merely rocked back and forth to release the cartridge C from the receptacle 10 in a manner as is explained in the aforementioned U.S. Pat. No. 4,742,909.

From the foregoing it should be evident that the present invention is one which allows for the construction of a receptacle whose walls are independently formed of a rigidity to retain the shape and integrity of the construction while the cartridges are held in separate cartridge retaining means which may be designed of a flexibility to firmly retain the cartridge within the receptacle and release the cartridge from the receptacle for use, the cartridge retaining elements being independent of the receptacle wall construction.

While it is apparent that modifications and changes can be made within the spirit and scope of the present invention, it is our intention, however, only to be limited by the appended claims.

As our invention we claim:

1. A one piece receptacle for retaining and dispensing a plurality of razor blade cartridges said receptacle being open at the top and formed of a pair of opposed end walls, a pair of opposed side walls and a bottom wall;

means extending between and interconnecting said opposed side walls for dividing said receptacle into a plurality of individual cartridge cavities, and comprising a plurality of separator walls disposed substantially parallel to said end walls and spaced one from the other and from said end walls; and, means for retaining a razor blade cartridge in spaced relation in a cavity comprising a pair of flanges, each having one edge connected to one of said opposed side walls and a free edge extending inwardly, each of said flanges being spaced from an adjacent one of said parallel separator and end walls and having a detent disposed adjacent an upper edge of each flange for retaining a razor blade cartridge between said detent and said bottom wall.

2. A one piece receptacle as set forth in claim 1 wherein each of said flanges has an edge fixed to said bottom wall.

3. A one piece receptacle as set for in claim 1 which further includes means disposed on said end walls and said dividing means for guiding a razor blade cartridge into said razor blade cartridge retaining means.

4. A one piece receptacle as set forth in claim 1 wherein said retaining means includes a pair of spacer elements disposed in each of said cavities, one attached to each of said opposed side walls for retaining a razor blade cartridge therebetween and in spaced relation with said side walls.

5. A one piece receptacle as set forth in claim 1 wherein each of said cavities further comprises means formed on said bottom wall for supporting a cartridge disposed therein in spaced relation with said bottom wall.

6. A one piece receptacle as set forth in claim 5 wherein each of said flanges has an edge fixed to said bottom wall.

7. A one piece receptacle as set forth in claim 6 wherein each of said flanges has a detent disposed adjacent the upper edge thereof and extending outwardly from a surface thereof for retaining a razor blade cartridge between said detent and said bottom wall.

8. A one piece receptacle as set for in claim 7 which further includes means disposed on said end walls and said separator walls for guiding a razor blade cartridge into a cavity between said end walls and said separator walls.

9. A one piece receptacle as set forth in claim 8 wherein said retaining means includes a pair of spacer elements disposed in each of said cavities, one attached to each of said opposed side walls for retaining a razor blade cartridge therebetween and in spaced relation with said side walls.

10. A one piece receptacle for retaining and dispensing a plurality of razor blade cartridges said receptacle being open at the top and formed of a pair of opposed end walls, a pair of opposed side walls and a bottom wall;

a plurality of separator walls extending between said opposed side walls dividing said receptacle into a plurality of individual cartridge cavities, said separator walls disposed substantially parallel to said end walls and spaced one from the other and from said end walls; and a pair of flanges disposed within each of said cavities, each having one edge adjacent one of said opposed side walls and a free edge disposed inwardly of said side wall, each of said flanges being spaced from an adjacent one of said parallel separator and end walls and having a detent disposed adjacent an upper edge of each flange for retaining a razor blade cartridge between said detent and said bottom wall.

11. A one piece receptacle as set forth in claim 10 wherein said separator walls interconnect said opposed side walls.

12. A one piece receptacle as set forth in claim 10 wherein each flange of said pair of flanges has one edge connected to one of said opposed side walls.

13. A one piece receptacle as set forth in claim 10 wherein each flange of said pair of flanges has one edge connected to said bottom wall.

14. A one piece receptacle as set forth in claim 10 wherein each cavity has two pairs of flanges, each pair adjacent respective opposed side walls.

* * * * *